US008186104B2

(12) United States Patent
Barnea et al.

(10) Patent No.: US 8,186,104 B2
(45) Date of Patent: May 29, 2012

(54) DETACHABLE TRACKS FOR SLIDING DOORS AND WINDOWS

(76) Inventors: Michael Barnea, Kadima (IL); Ami Schwartzberg, Ramat-Gan (IL)

( * ) Notice: Subject to any disclaimer, the term of this patent is extended or adjusted under 35 U.S.C. 154(b) by 387 days.

(21) Appl. No.: 12/439,546

(22) PCT Filed: Sep. 3, 2007

(86) PCT No.: PCT/IL2007/001086

§ 371 (c)(1),
(2), (4) Date: Mar. 2, 2009

(87) PCT Pub. No.: WO2008/029394

PCT Pub. Date: Mar. 13, 2008

(65) Prior Publication Data

US 2009/0193719 A1 Aug. 6, 2009

Related U.S. Application Data

(60) Provisional application No. 60/824,441, filed on Sep. 3, 2006.

(51) Int. Cl.
*E05D 15/06* (2006.01)

(52) U.S. Cl. ..... 49/456; 49/453; 49/454; 49/409; 49/410; 49/411

(58) Field of Classification Search ..... 49/506, 49/504, 505, 453, 456, 457, 454, 410, 409, 49/411, 412, 406; 52/204.1, 204.51, 207, 52/656.1–656.9
See application file for complete search history.

(56) References Cited

U.S. PATENT DOCUMENTS 344,963 A * 7/1886 Hayes ..... 49/467
954,606 A * 4/1910 Baker ..... 49/457
1,723,642 A 8/1929 Bevans
1,902,949 A * 3/1933 Condon ..... 49/57
2,288,923 A 7/1942 Schiller
2,775,003 A 12/1956 Bianco
2,870,882 A * 1/1959 Tolman ..... 49/457
2,923,351 A * 2/1960 Zitomer ..... 160/381
3,081,852 A * 3/1963 Mendelsohn ..... 49/459
3,286,405 A * 11/1966 Schembri ..... 49/463
3,389,527 A * 6/1968 Collard ..... 52/844
3,566,563 A * 3/1971 Ruff ..... 52/211
3,579,943 A * 5/1971 Tam ..... 52/656.2
3,769,773 A * 11/1973 Mochizuki ..... 52/656.4
3,815,285 A * 6/1974 Kuyper ..... 49/501
4,069,627 A * 1/1978 Pegg ..... 52/93.1
4,098,027 A * 7/1978 Crance ..... 49/504
4,106,238 A * 8/1978 Bonello ..... 49/382
4,222,200 A * 9/1980 Beirnes ..... 49/63
4,308,692 A * 1/1982 Rumble et al. ..... 49/504
4,453,346 A * 6/1984 Powell et al. ..... 49/404
4,454,691 A * 6/1984 Mitchell ..... 52/202
4,488,387 A * 12/1984 Foti ..... 52/207
4,662,108 A * 5/1987 Duran Romero et al. ..... 49/130
5,297,891 A * 3/1994 Rosa ..... 403/402

(Continued)

*Primary Examiner* — Katherine w Mitchell
*Assistant Examiner* — Marcus Menezes

(57) ABSTRACT

The present invention provides a rail system for a horizontally sliding door or window having a construction casing; and at least one slideable panel. The system includes, at least one track from which or on which the panel slides. Each track includes, at least two track segments whose length is shorter than the width of the slideable panel(s). The track further includes a track segment fastening mechanism for allowing the track segments to be removed and re-inserted into the construction casing; and a spacer disposed between adjacent track segments. The total length of each spacer and one of each of its adjacent track segments is greater than the width of the slideable panel(s).

7 Claims, 5 Drawing Sheets

U.S. PATENT DOCUMENTS

| | | | | |
|---|---|---|---|---|
| 5,611,173 | A * | 3/1997 | Headrick et al. | 49/468 |
| 5,653,072 | A * | 8/1997 | Seelandt-Stasek et al. | 52/204.1 |
| 6,003,279 | A * | 12/1999 | Schneider | 52/481.1 |
| 6,006,375 | A * | 12/1999 | Carr | 4/613 |
| 6,206,453 | B1 * | 3/2001 | Farrar et al. | 296/146.15 |
| 6,233,888 | B1 * | 5/2001 | Wu | 52/207 |
| 6,345,477 | B1 * | 2/2002 | Kepler et al. | 52/204.1 |
| 7,059,017 | B1 | 6/2006 | Rosko | |
| 7,263,808 | B2 * | 9/2007 | Massey et al. | 52/204.1 |
| 7,788,863 | B2 * | 9/2010 | Pepper et al. | 52/207 |
| 2001/0035268 | A1 * | 11/2001 | Desrochers | 160/31 |
| 2010/0043321 | A1 * | 2/2010 | Mees et al. | 52/213 |

* cited by examiner

DETACHABLE TRACKS FOR SLIDING DOORS AND WINDOWS

CROSS-REFERENCE TO RELATED APPLICATIONS

The present application claims the benefit of priority to U.S. Provisional Patent Application Ser. No. 60/824,441, filed Sep. 3, 2006, entitled "detachable tracks for sliding doors and windows" The aforementioned application is incorporated herein by reference.

FIELD OF THE INVENTION

The present invention relates in general to sliding doors and windows systems. More particularly, the invention relates to tracks for sliding doors and windows.

BACKGROUND OF THE INVENTION

Sliding doors move along metal, wood, or plastic resin tracks. Sliding doors and windows consist of one or more panels, which slide on one or more tracks, or are suspended from one or more tracks. Each such panel consists of a frame (usually metallic, wooden or plastic) onto which wheels may be attached. The frame typically houses a sheet of glass or plastic, a screen or a set of slats. One or more tracks are supported by a construction element such as a wall, floor or window/door interior casing, forming a smooth plane on which the track is laid.

Typically, a guide rail of the track protrudes in a direction normal to the base of the track, to guide each door or window panel. Typically, to drain water at the window/door bottom interior casing the tracks are made shorter than the window/door bottom interior casing, forming a gap through which water can be drained from the interior of the window casing. Also, slots along the track are usually made to assist in such water drainage.

Traditional sliding window/door track systems tend to collect dirt and are not convenient to clean. The tracks usually employ conspicuous metal rail guides that pose a serious impediment to both foot and wheel traffic. Even in the presumed safety of one's home, the persistence of this awkward structural feature can cause passers-by to trip and fall. In addition, handicapped persons in wheelchairs find it almost impossible to traverse this impediment without able assistance.

A particular sliding door is disclosed in U.S. Patent Application publication number 2006/0143856A1. One of its features is the elimination of the rail guide on the traditional sliding track. The rail guide is replaced by a pair of solid metal rails.

SUMMARY OF THE INVENTION

The present invention relates in general to sliding doors and windows systems. More particularly, the invention relates to tracks for sliding doors and windows.

In accordance with an embodiment of the present invention there is provided a rail system for a horizontally sliding door or window having a construction casing; and at least one slideable panel. The system includes, at least one track from which or on which the panel slides. Each track includes, at least two track segments whose length is shorter than the width of the slideable panel(s). The track further includes a track segment fastening mechanism for allowing the track segments to be removed and re-inserted into the construction casing; and a spacer disposed between adjacent track segments. The total length of each spacer and one of each of its adjacent track segments is greater than the width of the slideable panel(s).

BRIEF DESCRIPTION OF THE DRAWINGS

The invention may be understood upon reading of the following detailed description of non-limiting exemplary embodiments thereof, with reference to the following drawings, in which.

DETAILED DESCRIPTION OF EMBODIMENTS OF THE INVENTION

In accordance with the present invention a sliding door/window with detachable rail track segments is provided. The track, is formed as a sequence of track components, is supported by a construction element. The track components are fitted into the window interior casing at the top, bottom or both so that the window frame can slide horizontally. One end a track segment is fastened to the construction element by pins, screws or any other fastening method and at the second end by a clip or any other fastening method. Under normal circumstances the track functions as a traditional sliding window/door track, but subsequent to the detachment and the removal, a smooth surface is left below the level of the removed track segment.

Figure 1:
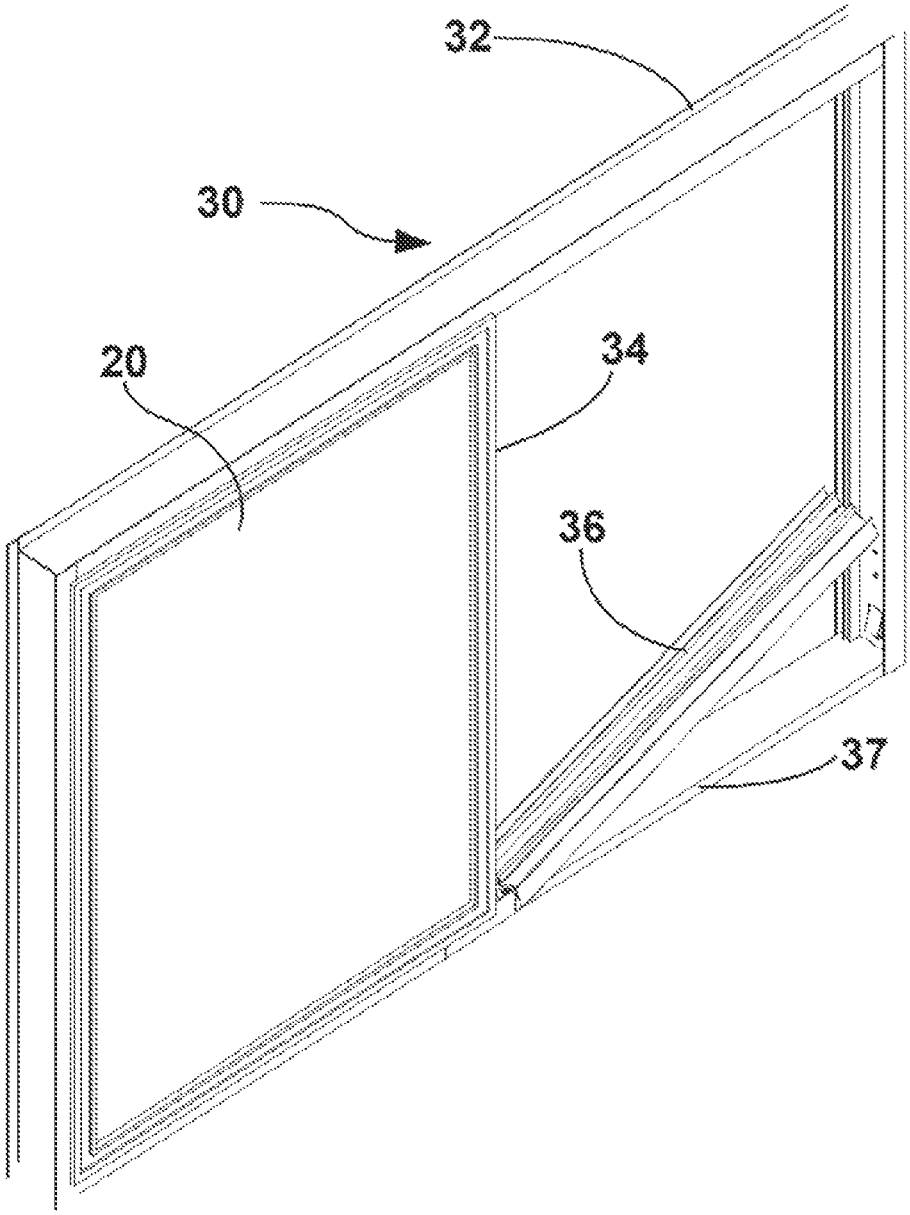
FIG. 1 is a schematic depiction of a sliding window with detachable track segments.
Figure 2A:
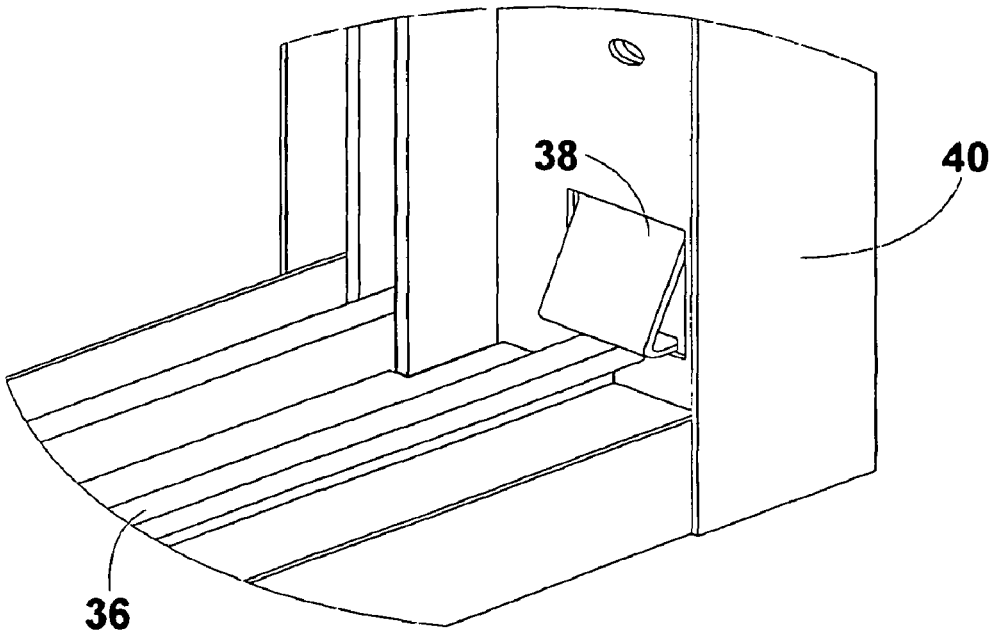
FIG. 2A is a schematic depiction of one end of a rail track segment fastened to the bottom interior casing of a sliding window.

An example of a sliding window in accordance with the present invention is shown schematically in FIG. 1. Sliding window 30 comprises a window casing 32, which may be made of metal, wood, plastic resin or any other suitable materials. The track components are fitted into the window bottom interior casing so that a panel 20 having a window frame 34 can slide horizontally within the casing along the guiding rail track. Track segment 36 is made such that when it is removed, as indicated in the figure, a smooth surface of window bottom interior casing 37 is left. An example of a mechanism for disassembling and assembling the track segment will be described next. In FIG. 2A, one end of the track segment fastened to the window interior casing is shown. One end of the track segment (not shown), is a fixed to the window bottom interior casing in a manner which will be explained later. The other end of the track segment 36 is fixed to the window bottom interior casing by outwardly biased tongue 38 that secures the track segment by pressing downward against the bottom interior casing and preventing it from sticking up. To release one end of the track segment, biased tongue 38 is pressed towards the casing. The outwardly biased tongue 38 is fastened at the bottom side of casing 40.

Figure 2B:
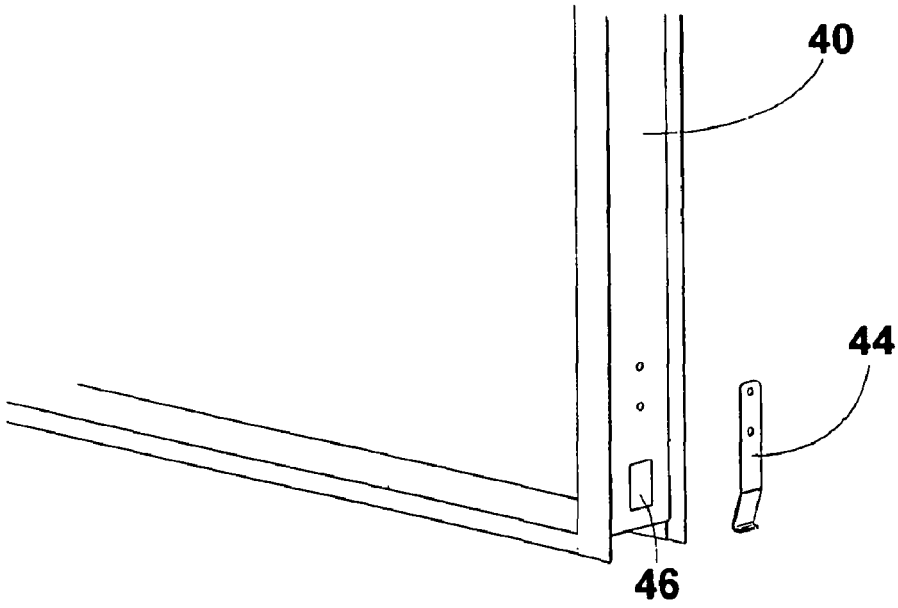
FIG. 2B is a schematic depiction of a sided window casing.
Figure 3A:
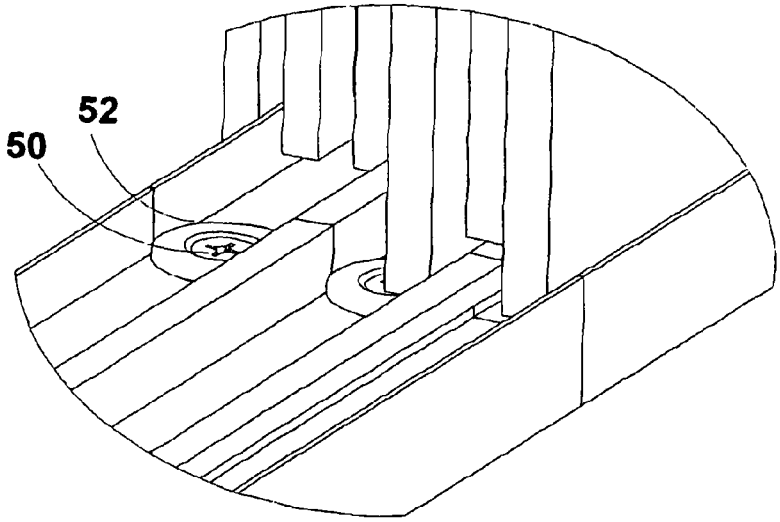
FIG. 3A is a schematic depiction showing the second end side rail track segment fastened to a sliding window bottom interior casing.
Figure 3B:
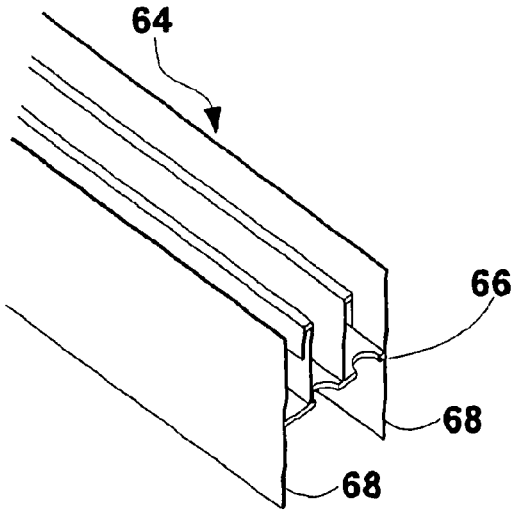
FIG. 3B is a schematic depiction of a window track segment profile.

The biased tongue and function are explained in more detail with reference to FIG. 2B. Spring element 44 is a simple straight and flat resilient metal rod with holes in one side to secure to the bottom part of the outer casing by screws, not shown. In the other end the metal rod is bent to some degree of inclination. The inclined portion is referred to as the biased element or tongue. The dimensions of tongue 38 are such that it enters the bottom side interior casing through rectangular window 46, to secure one end of track segment 36 as described above. The other end of track segment 36 is fixed by screws and discs to interior casing of the window bottom as shown in FIG. 3A. The surface area of screws 50 heads can be increased by adding disc 52 made of metal or plastic resin. In FIG. 3B one end side of the track 64 is shown. Arcuate notches 66 are made in the edge of the track surface, such that the screws can pass through the track and secure the track to the bottom interior casing of the window. Two flat vertical plates 68 flanking the track segment protect the track from slipping either side. The vertical plates also prevent penetration of natural elements (e.g. light, wind and water) between track bottom surface and interior bottom casing surface.

Figure 3C:
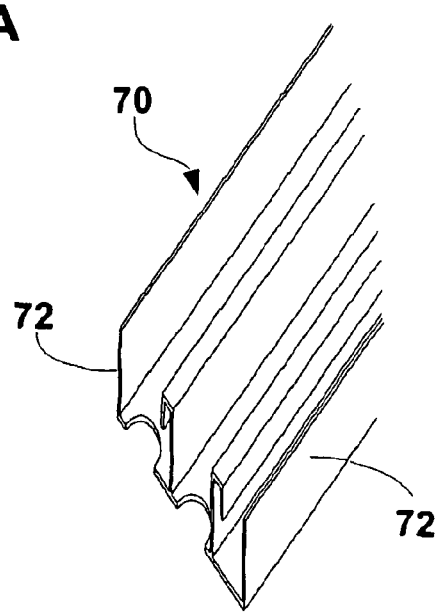
FIG. 3C is a schematic depiction of a door track segment profile.
Figure 4:
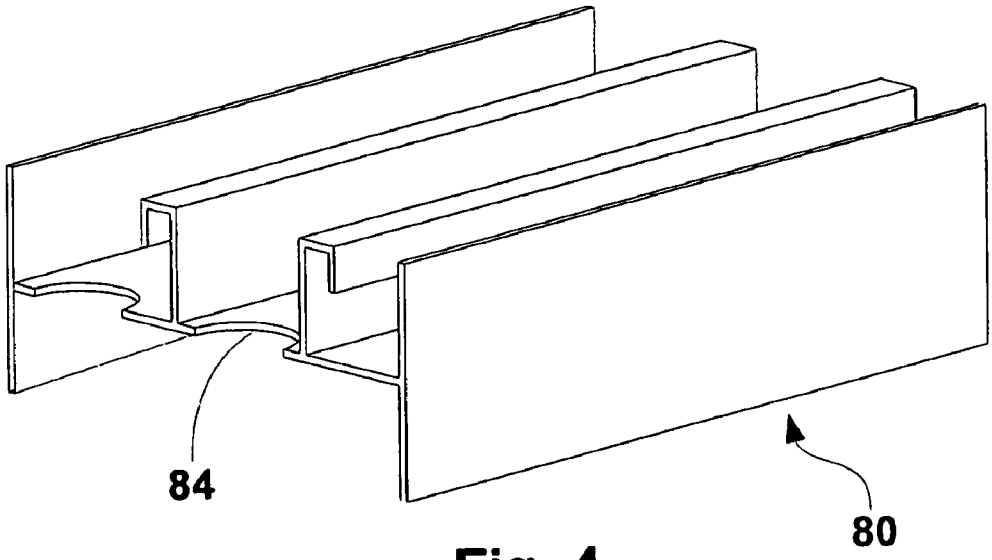
FIG. 4 is a schematic depiction of a spacer.
Figure 5:
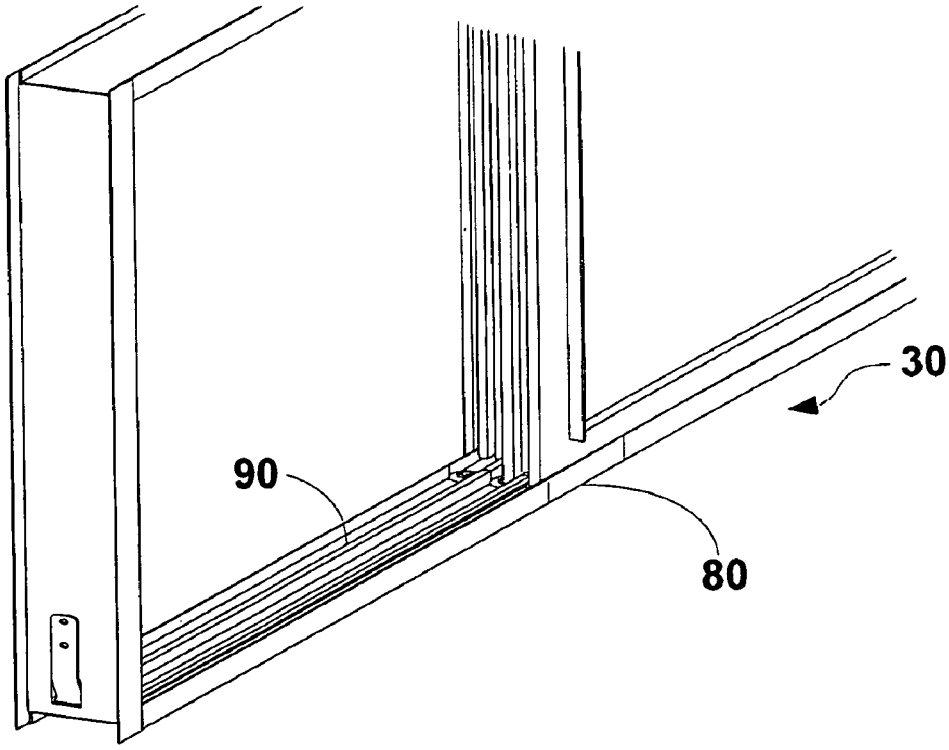
FIG. 5 is a schematic depiction showing one application of spacers.

In another example as shown in FIG. 3C, a track segment 70 is employed in a sliding door context, in accordance with the present invention. Two flanking vertical plates 72 are not elongated beyond the track bottom surface, however the track is fixed to a construction element (not shown in FIG. 3C) as described in the former example or by any other fastening method. In some embodiments of the present invention a segment of a track as shown in FIG. 4 is used. Track component 80 is referred to hereinafter as a spacer. In both ends, arcuate notches 84 are made such that the screws, not shown, can pass through the spacer and secure the spacer to the construction element. Typical use of the spacer is shown in FIG. 5 to which reference is now made. In this particular example spacer 80 is installed in the middle of the window's bottom interior casing. Track segments 90 are sufficiently short in order to enable the removal of the tracks when sliding the windows to either side. The spacer could be applicable similarly to sliding doors or any other panels. In some embodiments of the present invention a securing subsystem is used that keeps the panel in one end of the spacer or track thus preventing the panel from slipping from the track segment onto the smooth surface from which the respective track has already been removed.

The detachable track segments with or without spacers could be of use in other applications. For example, when the sliding door/window is very long, the track segments which are either disposed at the bottom or upper window/door casing can bend and damage as a result of the door/window pressure; therefore instead of fabricating a long track the track is partitioned to shorter tracks and are joined together by installing a spacer between each two track segments. In another application, the system of the present invention can be used as a part of a folding door system. In such case, the door casing in which movable panels are placed facilitates folding up the panels sideways. When using such a door system a spacer is joined with a track segment to the bottom door casing. The spacer is usually installed in either bottom door casing side; the dimensions of the spacer and tracks provide for removal of the track segments when the folding door is completely or partially opened. In another application the detachable tracks with or without spacers are used for vertical sliding windows i.e. the track segments and spacers are fastened to the interior casing sides, rather than to the top or bottom.

Figure 6:
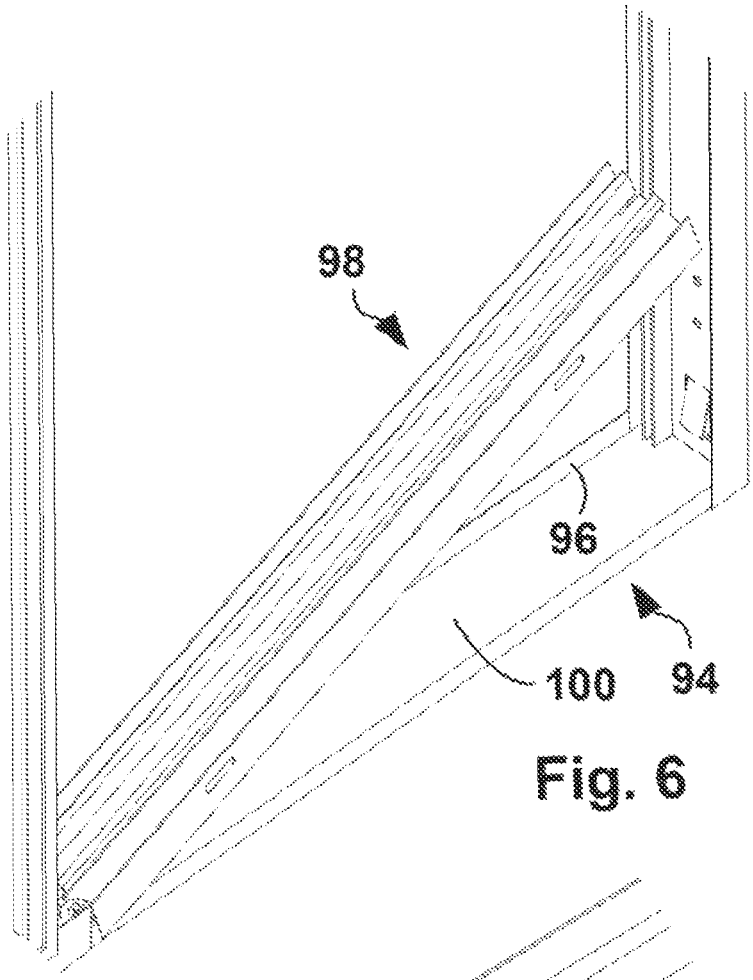
FIG. 6 is a schematic depiction of a sliding window with detachable track segments in accordance with the preferred embodiment of the present invention.

In some embodiments of the present invention, the interior side of the surface of the window bottom casing further includes a flat vertical plate flanking the surface disposed in an upright position. A schematic description of a sliding window with detachable track system in accordance with a preferred embodiment of the present invention is shown in FIG. 6. At the bottom interior casing 94, a flat vertical plate 96 flanking the surface of bottom interior casing 94 in an upright position. Track component 98 is fitted into the window such that when removed, as indicated in the figure; smooth surface 100 of window bottom casing 94 shows up.

Figure 7:
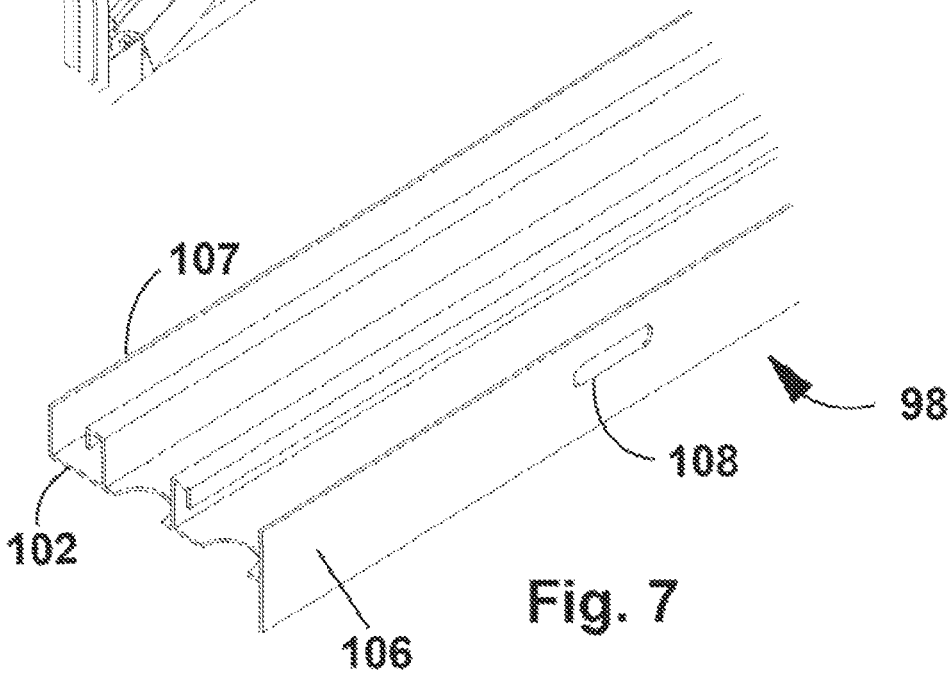
FIG. 7 is a schematic depiction of a window track segment in accordance with the preferred embodiment of the present invention.

Referring now to FIG. 7, in which according to some preferred embodiments, track 98 consisting base plate 102 and two flat vertical plates 106, 107 extending therefrom and respectively flanking the track on both sides. These plates are intended to protect the track from slipping side-wise. Vertical plate 107 extends from base plate 102 upwards whereas vertical plate 106 extends from base plate 102 upwards and downwards. Vertical plate 106 also prevents penetration of environmental elements (e.g. light, wind and water) between the track's bottom surface and the surface of the interior bottom casing. If water penetrates the track, one or more holes 108 of flat vertical plate 106 can deliver the penetrated water out side of the window system.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

Benefits of the Present Invention

The simple and quick detaching of a sliding window/door track can be of assistance in maintaining the door/window system on a daily basis by conveniently removing them very easily from a construction element. When the rail track is removed a smooth surface is left at the construction element in which a smooth passage of wheel traffic is feasible. The implementation of the track system of the invention does not complicate design or the manufacturing of sliding windows/door system nor make it more costly.

The invention claimed is:

1. A rail system for a horizontally sliding door or window having a construction casing and at least one slidable panel the system comprising:

a disc fixed to the construction casing; and at least one track on which the at least one slidable panel slides, each track comprising:

at least two track segments, each track segment having a length shorter than the width of the at least one slidable panel and having an arcuate notch at the edge of an end of the track segments corresponding to the disc for removably securing the track to the casing;

a spacer disposed between adjacent track segments, the total length of each spacer and one of each of its adjacent track segments is greater than the width of the at least one slidable panel; and a track segment assembly mechanism for allowing the track segments to be removed and re-inserted into the construction casing, whereby removal and re-installation of one of the track segments is enabled for facilitating cleaning thereof without removal of the at least one slidable panel.

2. A rail system as in claim 1, wherein the track is disposed below the at least one slidable panel.

3. A rail system as in claim 1, wherein the construction casing comprises a flat vertical plate extending upward at an inner side of the casing.

4. A rail system as in claim 1, wherein the construction casing is flat and flush with an adjacent floor or window sill.

5. A rail system as in claim 1, wherein said track further comprises a first flat vertical plate and a second flat vertical plate, both vertical plates flanking a base plate of said track on both sides and perpendicularly extending therefrom, wherein the first vertical plate extends upwards from said track's base plate, and the second vertical plate extends from said base plate of said track both upwards and downwards and has at least one hole disposed therein above the level of said base plate.

6. A method of facilitating cleaning of a door or window track, or a construction casing upon which the track is positioned, of a horizontally sliding door or window system having at least one horizontally slidable panel and a disc fixed to the construction casing, the method comprising:

providing said track in the form of a plurality of track segments with a spacer disposed between adjacent track segments, each track segment having a length shorter than the width of the at least one horizontally slidable panel; and an arcuate notch at an edge of one end thereof;

sliding said panel within said track to a position away from at least one of the track segments thereby exposing a single track segment of the plurality of track segments;

releasing the single track segment by pressing a biased tongue of a track segment assembly mechanism; and removing the single track segment, by distancing the arcuate notch of the single track segment from the disc of the casing, whereby at least one track segment or the construction casing adjacent the one track segment can be cleaned without removal of the panel from the construction casing.

7. A rail system as in claim 1, wherein the track segment assembly mechanism comprises an outwardly biased tongue.

* * * * *